US007913399B2

(12) United States Patent
Lau

(10) Patent No.: US 7,913,399 B2
(45) Date of Patent: Mar. 29, 2011

(54) BLADE SET FOR HAIR CLIPPER

(75) Inventor: Tung Yan Lau, N.T. (HK)

(73) Assignee: Specialife Industries Limited, N.T. (HK)

( * ) Notice: Subject to any disclaimer, the term of this patent is extended or adjusted under 35 U.S.C. 154(b) by 230 days.

(21) Appl. No.: 11/623,088

(22) Filed: Jan. 14, 2007

(65) Prior Publication Data

US 2008/0168661 A1 Jul. 17, 2008

(51) Int. Cl.
*B26B 19/06* (2006.01)
*B26B 19/28* (2006.01)

(52) U.S. Cl. ..... 30/241; 30/43.92; 30/194; 30/208

(58) Field of Classification Search ..... 30/43, 43.7, 30/43.91, 43.92, 131, 194, 195, 208, 241, 30/242, 243

See application file for complete search history.

(56) References Cited

U.S. PATENT DOCUMENTS

| | | | | | |
|---|---|---|---|---|---|
| 1,075,908 | A | * | 10/1913 | Dyer | 30/201 |
| 2,214,069 | A | * | 9/1940 | Sikora | 30/201 |
| 2,233,445 | A | * | 3/1941 | Andis | 30/43.92 |
| 2,275,180 | A | * | 3/1942 | Holsclaw | 30/29.5 |
| 2,347,869 | A | * | 5/1944 | Amdur | 30/43.91 |
| 2,347,870 | A | * | 5/1944 | Amdur | 30/43.91 |
| 5,504,997 | A | * | 4/1996 | Lee | 30/34.1 |
| 5,531,027 | A | * | 7/1996 | Martinez et al. | 30/216 |

* cited by examiner

*Primary Examiner* — Edward Landrum

(57) ABSTRACT

A blade set for hair clipper which has a lower fixed blade, an upper fixed blade, a movable blade assembly and a blade holder. The movable blade assembly is disposed in between the lower fixed blade and the upper fixed blade and is connected to a driving means driven by a driving unit in the hair clipper to reciprocate laterally relative to the lower fixed blade and the upper fixed blade in an operating condition. A third toothed front edge is provided at a front end of the movable blade assembly. A lower portion of the third toothed front edge cooperates with an upper portion of the first toothed front edge to define a first cutting surface. An upper portion of third toothed front edge cooperates with a lower portion of the second toothed front edge to define a second cutting surface.

16 Claims, 6 Drawing Sheets

BLADE SET FOR HAIR CLIPPER

BACKGROUND OF THE INVENTION

The present invention relates to a blade set and more particularly pertains to a blade set for hair clipper which has a movable blade disposed between an upper fixed blade and a lower fixed blade and reciprocating laterally relative to the two fixed blades.

Blade sets for hair clippers available in the marketplace generally have a fixed blade and a movable blade. Lateral reciprocation of the movable blade relative to the fixed blade results in a cutting action. Since the movable blade is exposed to users during the cutting action, it is easy for users to get injured by the movable blade.

BRIEF SUMMARY OF THE INVENTION

In view of the aforesaid disadvantages now present in the prior art, the present invention provides a blade set for hair clipper which has one movable blade assembly disposed between an upper fixed blade and a lower fixed blade and reciprocating laterally relative to the two fixed blades. Since the movable blade assembly is covered by the two fixed blades, users are protected from getting injured by the moving blade assembly during the cutting action.

To attain this, the present invention generally comprises a lower fixed blade, an upper fixed blade, a movable blade assembly and a blade holder. The lower fixed blade is provided with a first toothed front edge. The upper fixed blade is provided with a second toothed front edge which is disposed on top of the lower fixed blade and aligned corresponding to the lower fixed blade so that the teeth of the first toothed front edge and the second toothed front edge do not overlap with each other. The movable blade assembly is disposed in between the lower fixed blade and the upper fixed blade and is connected to a driving means driven by a driving unit in the hair clipper to reciprocate laterally relative to the lower fixed blade and the upper fixed blade in an operating condition. A third toothed front edge is provided at a front end of the movable blade assembly. A lower portion of the third toothed front edge cooperates with an upper portion of the first toothed front edge to define a first cutting surface. An upper portion of third toothed front edge cooperates with a lower portion of the second toothed front edge to define a second cutting surface. The blade holder secures the lower fixed blade, the movable blade assembly and the upper fixed blade together to form a blade set and the blade set is connected to the hair clipper.

In one preferred embodiment, the movable blade assembly comprises one blade, and the blade is provided with a toothed front edge constituting the third toothed front edge. Each tooth of the toothed front edge of the movable blade assembly has a cross-sectional shape of a rectangle.

In another preferred embodiment, the movable blade assembly comprises a lower movable blade provided with a toothed front edge constituting the lower portion of the third toothed front edge, and an upper movable blade disposed fixedly on top of the lower movable blade and provided with a toothed front edge constituting the upper portion of the third toothed front edge, and the toothed front edge of the lower movable blade and the toothed front edge of the upper movable blade overlap with each other. Each tooth of the toothed front edge of the lower movable blade has a cross-sectional shape of an isosceles trapezoid, and each tooth of the toothed front edge of the upper movable blade has a cross-sectional shape of an inverted isosceles trapezoid.

In another preferred embodiment, each tooth of the first toothed edge of the lower fixed blade is integrally provided with a first protecting piece extending upward from a front end thereof, and each tooth of the second toothed edge of the upper fixed blade is integrally provided with a second protecting piece extending downward from a front end thereof. The thickness of the first and second protecting pieces is adapted to allow the movable blade assembly to reciprocate laterally. The first and second protecting pieces protect the user's hand from getting injured by the movable blade assembly.

The blade holder comprises a pressing piece and a base secured under the lower fixed blade and connected to the pressing piece, and the pressing piece presses against a top surface of the upper fixed blade. The base is provided with one or more pins which extend upward towards a lower surface of the pressing piece and pass through corresponding openings provided on each of the lower fixed blade, the movable blade assembly and the upper fixed blade, thereby securing the lower fixed blade, the movable blade assembly and the upper fixed blade in an assembled relation. The size of each opening of the movable blade assembly is larger than that of the corresponding pin so as to allow reciprocating actions of the movable blade assembly.

In one preferred embodiment, the base and the pressing piece are connected to each other by means of a torsion spring. The torsion spring comprises a coil member and two ends and is connected to the base via a rod. The rod passes through the coil member and is disposed at a rear end of the base. The two ends of the torsion spring are attached to the pressing piece, and the pressure exerted by the pressing piece against the upper fixed blade, the movable blade assembly and the lower fixed blade enables the three blades to be secured in an assembled relation. The rear end of the base is provided with two walls opposite to each other, one on the left side and one on the right side, and each wall is provided with a through hole in the middle for receiving one end of the rod.

In another preferred embodiment, a spring plate is disposed on top of the pressing piece to exert pressure against the pressing piece. A rear end of the base is provided with two nuts, one on the left side and one on the right side, for receiving two screws which pass through two corresponding holes on the spring plate.

The base is provided with a recess at its front end for receiving the lower fixed blade, and the shape of the recess corresponds to that of the lower fixed blade.

A guarding piece is disposed on top of each opening of the movable blade assembly for protecting the movable blade assembly from wear and tear during reciprocation.

The driving means is provided with one or more connecting pieces, and the movable blade assembly is provided with one or more notches corresponding to the connecting pieces for receiving the connecting pieces.

The connecting pieces pass through corresponding notches provided on each of the upper fixed blade, the movable blade assembly and the lower fixed blade, and the size of each notch of the upper fixed blade and the lower fixed blade is larger than that of the corresponding connecting piece so as to allow reciprocating action of the connecting piece.

The base is provided with one or more two protrusions, one on left side and one on right side, for connecting the blade set to the hair clipper.

It is an object of the present invention to provide a new blade set which allows safer hair cutting operation by placing the movable blade assembly in between the upper fixed blade and the lower fixed blade, thus overcoming the disadvantages of the prior art.

It is another object of the present invention to provide a new blade set which is of simple and reliable construction.

It is a further object of the present invention to provide a new blade set which is susceptible of a low cost of manufacture with regard to both materials and labor, and which accordingly is then susceptible of low prices of sale to the consuming public, thereby making such blade set economically available to the buying public.

DETAILED DESCRIPTION OF THE INVENTION

Figure 1:
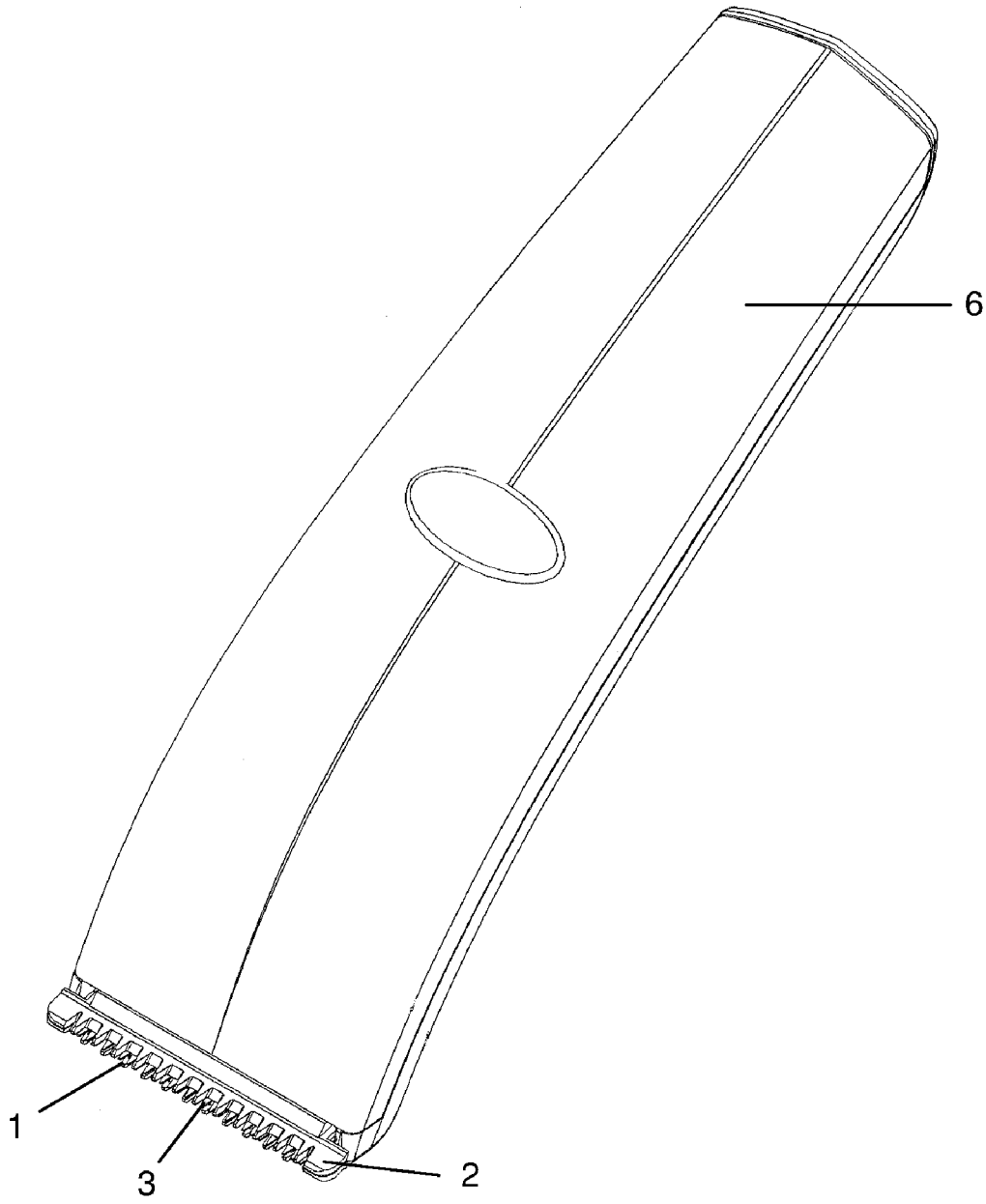
FIG. 1 shows the perspective view of the blade set of the first embodiment as connected to a hair clipper.
Figure 2:
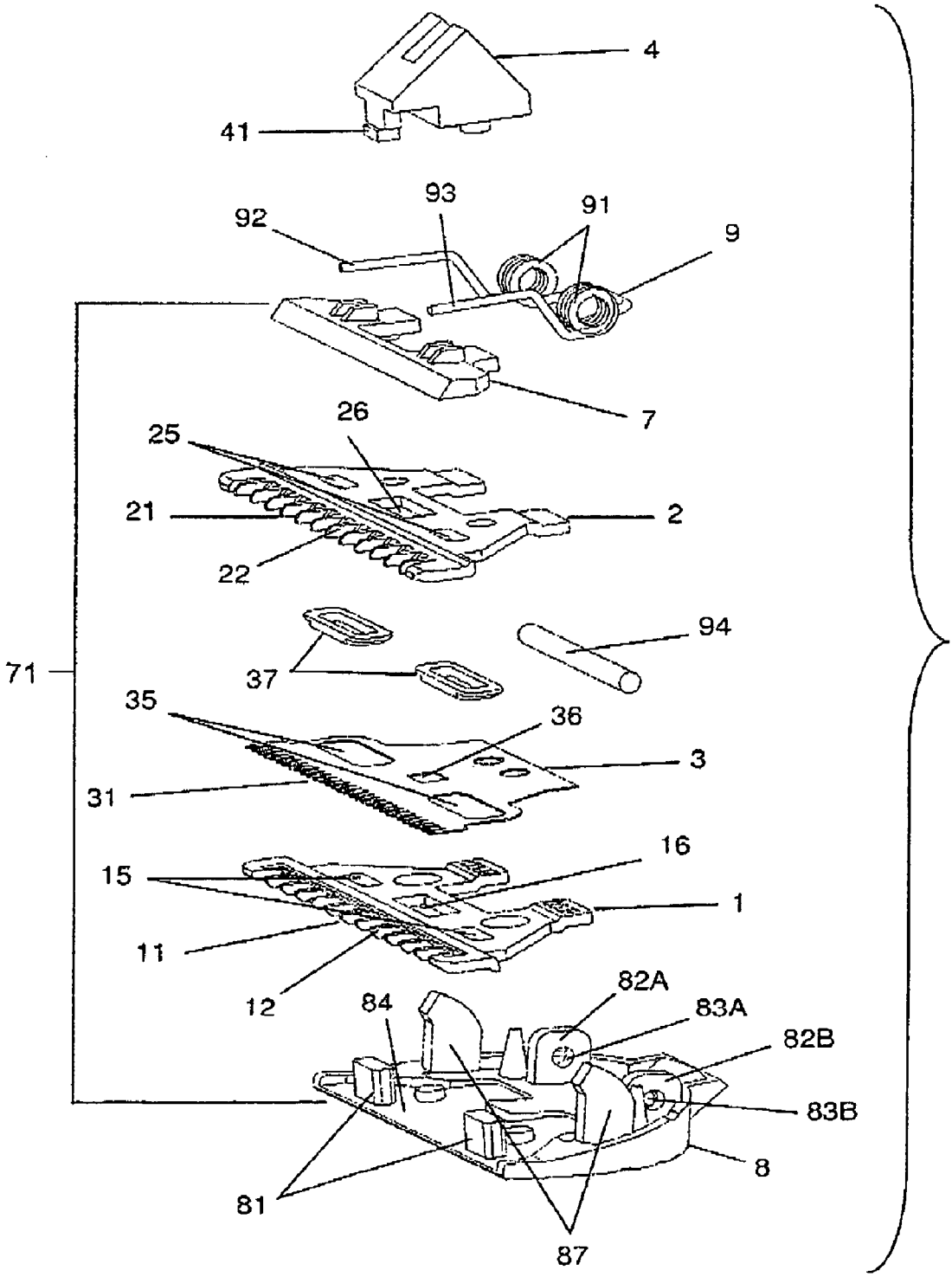
FIG. 2 shows the exploded view of the blade set of the first embodiment.
Figure 3:
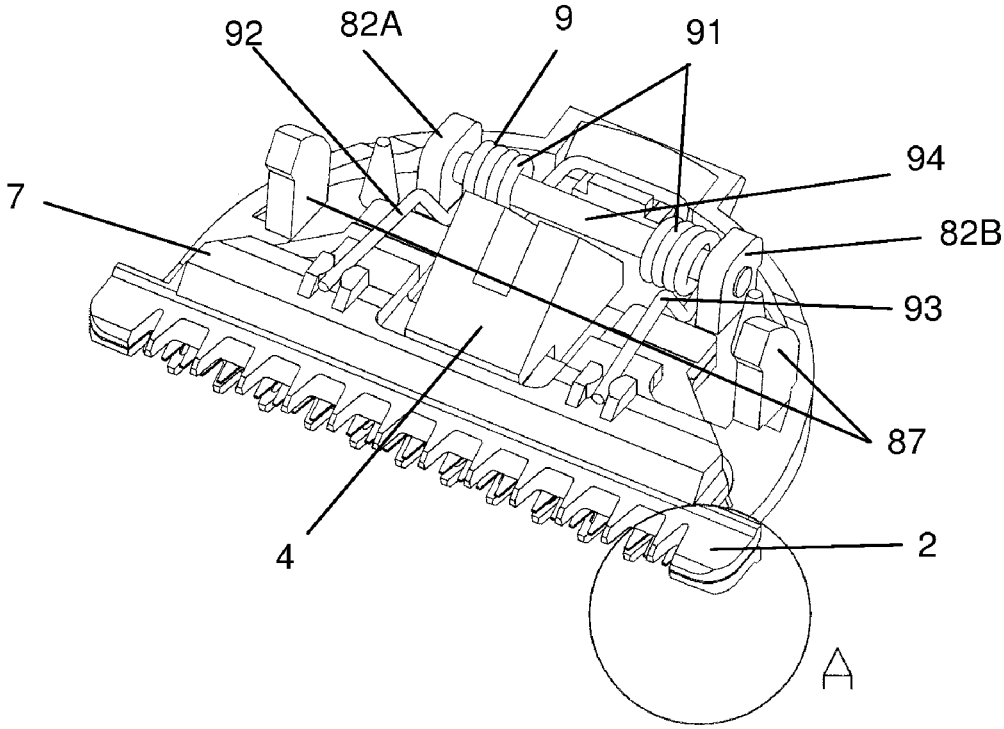
FIG. 3 shows the perspective view of the assembled blade set of the first embodiment.
Figure 4:
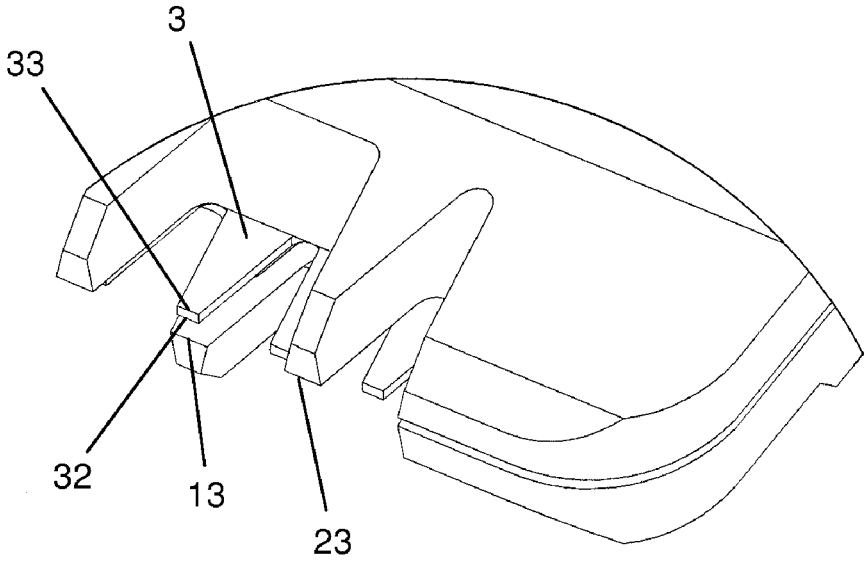
FIG. 4 shows the enlarged view of the portion A of FIG. 3.
Figure 5:
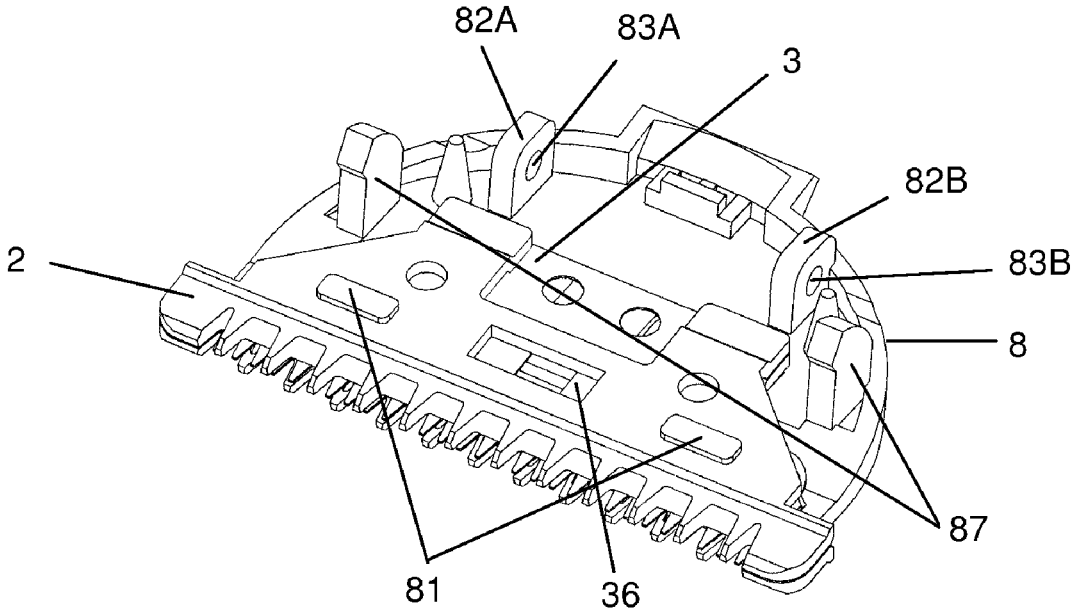
FIG. 5 shows the perspective view of the semi-assembled blade set of the first embodiment.

The present invention is further described in detail with the following embodiments and the accompanying drawings. FIGS. 1 to 5 illustrate the first embodiment of the present invention. As illustrated in FIGS. 1 and 2, the present invention comprises a lower fixed blade 1, an upper fixed blade 2, a movable blade assembly 3 and a blade holder 71. The lower fixed blade 1 is provided with a first toothed front edge 11. The upper fixed blade 2 is provided with a second toothed front edge 21 which is disposed on top of the lower fixed blade 1 and aligned corresponding to the lower fixed blade 1 so that the teeth 12, 22 of the first toothed front edge 11 and the second toothed front edge 12 do not overlap with each other. The movable blade assembly 3 is disposed in between the lower fixed blade 1 and the upper fixed blade 2 and is connected to a driving means 4 driven by a driving unit (not shown) in the hair clipper 6 to reciprocate laterally relative to the lower fixed blade 1 and the upper fixed blade 2 in an operating condition. The blade holder 71 secures the lower fixed blade 1, the movable blade assembly 3 and the upper fixed blade 2 together to form a blade set and the blade set is connected to the hair clipper 6. The blade holder 71 comprises a pressing piece 7 and a base 8 secured under the lower fixed blade 1 and connected to the pressing piece 7. The pressing piece 7 presses against a top surface of the upper fixed blade 2. The base 8 is provided with a recess 84 at its front end for receiving the lower fixed blade 1, and the shape of the recess 84 corresponds to that of the lower fixed blade.

The movable blade assembly 3 in this embodiment comprises one blade with a third toothed front edge 31 and each tooth thereof has a cross-sectional shape of a rectangle. The third toothed front edge 31 is provided at a front end of the movable blade assembly 3. A lower portion 32 of the third toothed front edge 31 cooperates with an upper portion 13 of the first toothed front edge 11 to define a first cutting surface. An upper portion 33 of third toothed front edge cooperates with a lower portion 23 of the second toothed front edge 21 to define a second cutting surface.

In this embodiment, the base 8 is provided with two pins 81 which extend upward towards a lower surface of the pressing piece 7 and pass through corresponding openings 15, 35, 25 provided on each of the lower fixed blade 1, the movable blade assembly 3 and the upper fixed blade 2, thereby securing the lower fixed blade 1, the movable blade assembly 3 and the upper fixed blade 2 in an assembled relation. The size of each opening 35 of the movable blade assembly 3 is larger than that of the corresponding pin 81 so as to allow reciprocating actions of the movable blade assembly 3. A guarding piece 37 is disposed on top of each opening 35 of the movable blade assembly 3 for protecting the movable blade assembly 3 from wear and tear during reciprocation.

In this embodiment, the base 8 and the pressing piece 7 are connected to each other by means of a torsion spring 9. The torsion spring 9 comprises a coil member 91 and two ends 92, 93 and is connected to the base 8 via a rod 94. The rod 94 passes through the coil member 91 and is disposed at a rear end of the base 8. The two ends 92, 93 of the torsion spring 9 are attached to the pressing piece 7, and the pressure exerted by the pressing piece 7 against the upper fixed blade 2, the movable blade assembly 3 and the lower fixed blade 1 enables the three blades to be secured in an assembled relation. The rear end of the base 8 is provided with two walls 82A, 82B opposite to each other, one on the left side and one on the right side, and each wall 82A, 82B is provided with a through hole 83A, 83B in the middle for receiving one end of the rod 94.

In this embodiment, the driving means 4 is provided with a connecting piece 41, and the upper fixed blade 2, the lower fixed blade 1 and the movable blade assembly 3 are each provided with a notch 26, 16, 36 corresponding to the connecting piece 41 for receiving the connecting piece 41. The connecting piece 41 passes through corresponding notches 26, 36, 16 provided on each of the upper fixed blade 2, the movable blade assembly 3 and the lower fixed blade 1. The size of each notch 26, 16 of the upper fixed blade 2 and the lower fixed blade 1 is larger than that of the corresponding connecting piece 41 so as to allow reciprocating action of the connecting piece 41. In other embodiments, it is possible for the connecting piece to pass through the corresponding notch in the movable blade assembly only. The base 8 is provided with two protrusions 87, one on left side and one on right side, for connecting the blade set to the hair clipper 6.

Figure 6:
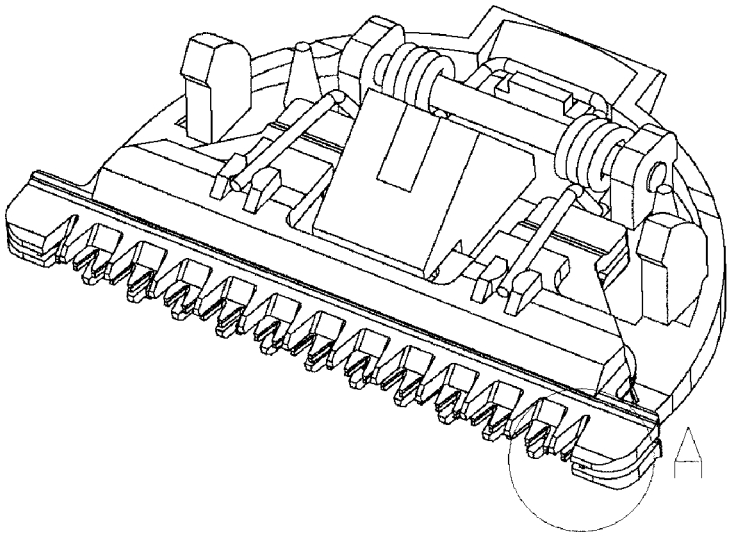
FIG. 6 shows the perspective view of the assembled blade set of the second embodiment.
Figure 7:
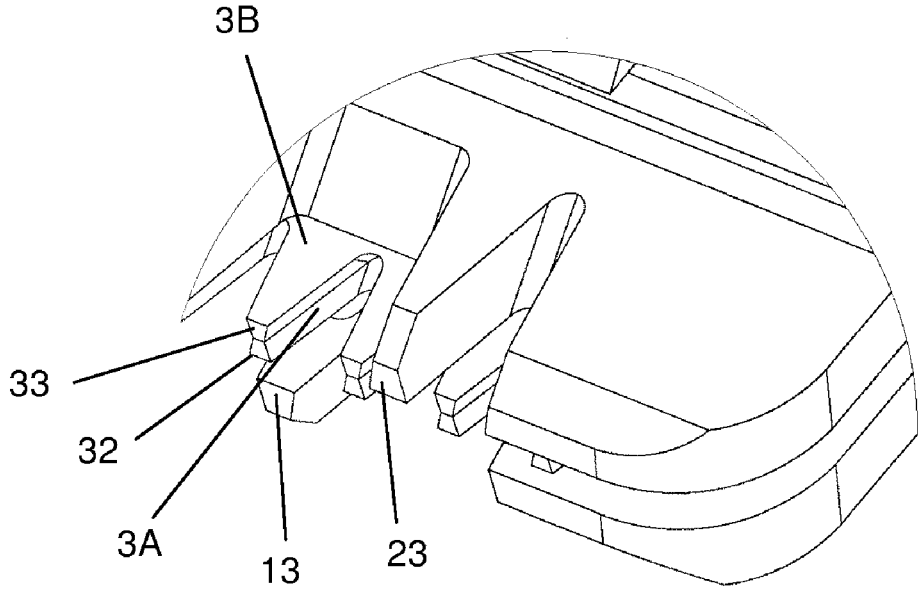
FIG. 7 shows the enlarged view of the portion A of FIG. 6.

FIGS. 6 and 7 illustrate the second embodiment of the present invention. The second embodiment is similar to the first embodiment except for the following. In this embodiment, the movable blade assembly comprises a lower movable blade 3A provided with a toothed front edge constituting the lower portion 32 of the third toothed front edge 31 in the first embodiment, and an upper movable blade 3B disposed fixedly on top of the lower movable blade 3A and provided with a toothed front edge constituting the upper portion 33 of the third toothed front edge 31 in the first embodiment. The toothed front edge of the lower movable blade 3A and the toothed front edge of the upper movable blade 3B overlap with each other. Each tooth of the toothed front edge of the lower movable blade 3A has a cross-sectional shape of an isosceles trapezoid, and each tooth of the toothed front edge of the upper movable blade 3B has a cross-sectional shape of an inverted isosceles trapezoid. Other structures of this embodiment are similar to those of the first embodiment and are therefore not described in detail.

Figure 8:
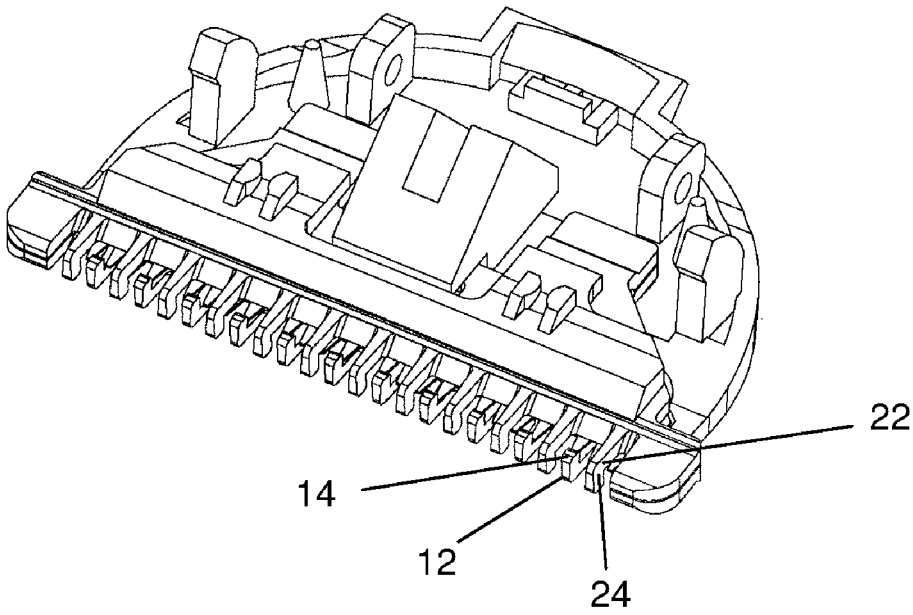
FIG. 8 shows the perspective view of the assembled blade set of the third embodiment.

FIG. 8 illustrates the third embodiment of the present invention. The third embodiment is similar to the first embodiment except for the following. In this embodiment, each tooth 12 of the first toothed edge 11 of the lower fixed blade 1 is integrally provided with a first protecting piece 14 extending upward from a front end thereof, and each tooth 22 of the second toothed 21 edge of the upper fixed blade 2 is integrally provided with a second protecting piece 24 extending downward from a front end thereof. The thickness of the first and second protecting pieces 14, 24 is adapted to allow the movable blade assembly 3 to reciprocate laterally. The first and second protecting pieces 14, 24 protect the user's hand from getting injured by the movable blade assembly. Other structures of this embodiment are similar to those of the first embodiment and are therefore not described in detail.

Figure 9:
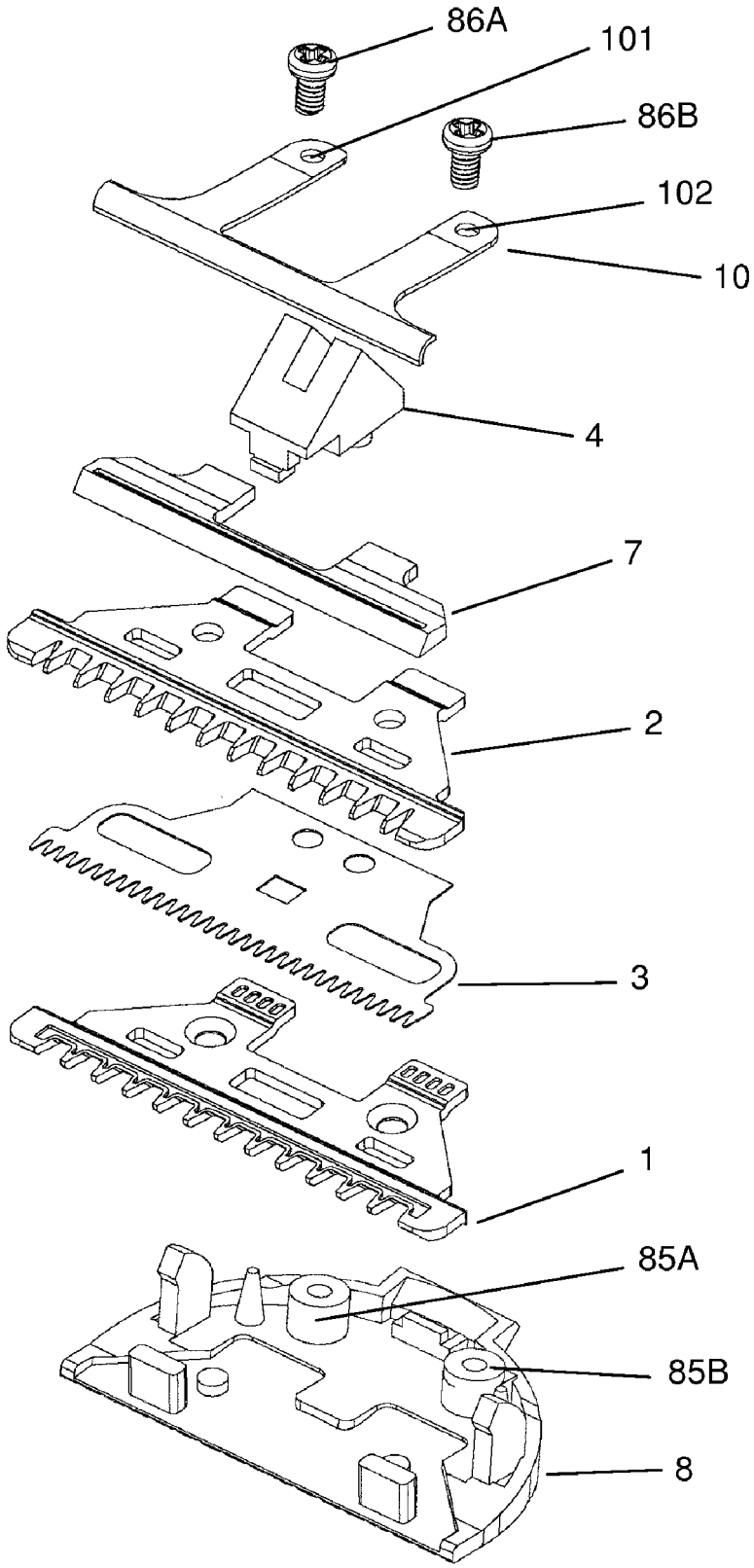
FIG. 9 shows the exploded view of the blade set of the fourth embodiment.

FIG. 9 illustrates the fourth embodiment of the present invention. The fourth embodiment is similar to the first embodiment except for the following. In this embodiment, a spring plate 10 is disposed on top of the pressing piece 7 to exert pressure against the pressing piece 7. A rear end of the base 8 is provided with two nuts 85A, 85B, one on the left side and one on the right side, for receiving two screws 86A, 86B which pass through two corresponding holes 101, 102 on the spring plate 10. Other structures of this embodiment are similar to those of the first embodiment and are therefore not described in detail.

As to a further discussion of the manner of usage and operation of the present invention, the same should be apparent from the above description. Accordingly, no further discussion relating to the manner of usage and operation is provided.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

The present invention is capable of other embodiments and of being practiced and carried out in various ways. It is to be understood that the phraseology and terminology employed herein are for the purpose of description and should not be regarded as limiting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. A blade set for hair clippers which comprises a lower fixed blade with a first toothed front edge;

an upper fixed blade with a second toothed front edge which is disposed on top of the lower fixed blade and aligned corresponding to the lower fixed blade so that the teeth of the first toothed front edge and the second toothed front edge do not overlap with each other;

a movable blade assembly which is flat and extends in a plane parallel to a lengthwise plane of the upper fixed blade and a lengthwise plane of the lower fixed blade and disposed in between the lower fixed blade and the upper fixed blade in such a way that a user's skin is protected from getting injured by the movable blade assembly;

a driving means connected to the movable blade assembly to reciprocate the movable blade assembly laterally relative to the lower fixed blade and the upper fixed blade in an operating condition;

a third toothed front edge provided at a front end of the movable blade assembly, a lower portion of which cooperates with an upper portion of the first toothed front edge to define a first cutting surface, and an upper portion of which cooperates with a lower portion of the second toothed front edge to define a second cutting surface; and a blade holder which secures the lower fixed blade, the movable blade assembly and the upper fixed blade together to form a blade set and the blade set is connected to the hair clippers;

the driving means is provided with a connecting piece, and the movable blade assembly is provided with a notch corresponding to the connecting piece for receiving the connecting piece; the connecting piece passes through corresponding notches provided on each of the upper fixed blade, the movable blade assembly and the lower fixed blade, and the size of each notch of the upper fixed blade and the lower fixed blade is larger than that of the corresponding connecting piece so as to allow reciprocating action of the connecting piece.

2. The blade set for hair clippers as in claim 1, wherein the movable blade assembly comprises one blade, and the blade is provided with a toothed front edge constituting the third toothed front edge and each tooth thereof has a cross-sectional shape of a rectangle.

3. The blade set for hair clippers as in claim 1, wherein the movable blade assembly comprises a lower movable blade provided with a toothed front edge constituting the lower portion of the third toothed front edge, and an upper movable blade disposed fixedly on top of the lower movable blade and provided with a toothed front edge constituting the upper portion of the third toothed front edge, and the toothed front edge of the lower movable blade and the toothed front edge of the upper movable blade overlap with each other.

4. The blade set for hair clippers as in claim 3, wherein each tooth of the toothed front edge of the lower movable blade has a cross-sectional shape of an isosceles trapezoid, and each tooth of the toothed front edge of the upper movable blade has a cross-sectional shape of an inverted isosceles trapezoid.

5. The blade set for hair clippers as in claim 1, wherein each tooth of the first toothed edge of the lower fixed blade is integrally provided with a first protecting piece extending upward from a front end thereof, and each tooth of the second toothed edge of the upper fixed blade is integrally provided with a second protecting piece extending downward from a front end thereof, and the thickness of the first and second protecting pieces is adapted to allow. the movable blade assembly to reciprocate laterally.

6. The blade set for hair clippers as in claim 1, wherein the blade holder comprises a pressing piece and a base secured under the lower fixed blade and connected to the pressing piece, and the pressing piece presses against a top surface of the upper fixed blade.

7. The blade set for hair clippers as in claim 6, wherein the base is provided with one or more pins which extend upward towards a lower surface of the pressing piece and pass through corresponding openings provided on each of the lower fixed blade, the movable blade assembly and the upper fixed blade, thereby securing the lower fixed blade, the movable blade assembly and the upper fixed blade in an assembled relation.

8. The blade set for hair clippers as in claim 7, wherein the size of each opening of the movable blade assembly is larger than that of the corresponding pin so as to allow reciprocating actions of the movable blade assembly.

9. The blade set for hair clippers as in claim 7, wherein a guarding piece is disposed on top of each opening of the movable blade assembly for protecting the movable blade assembly from wear and tear during reciprocation.

10. The blade set for hair clippers as in claim 6, wherein the base and the pressing piece are connected to each other by means of a torsion spring.

11. The blade set for hair clippers as in claim 10, wherein the torsion spring comprises a coil member and two ends and is connected to the base via a rod, and the rod passes through the coil member and is disposed at a rear end of the base, and the two ends of the torsion spring are attached to the pressing piece, and the pressure exerted by the pressing piece against the upper fixed blade, the movable blade assembly and the lower fixed blade enables the three to be secured in an assembled relation.

12. The blade set for hair clippers as in claim 11, wherein a rear end of the base is provided with two walls opposite to each other, one on a left side of the base and one on a right side of the base, and a through hole is provided in the middle of each wall for receiving one end of the rod.

13. The blade set for hair clippers as in claim 6, wherein a spring plate is disposed on top of the pressing piece to exert pressure against the pressing piece.

14. The blade set for hair clippers as in claim 13, wherein a rear end of the base is provided with two nuts, one on a left side of the base and one on a right side of the base, for receiving two screws which pass through two corresponding holes on the spring plate.

15. The blade set for hair clippers as in claim 6, wherein the base is provided with a recess at its front end for receiving the lower fixed blade, and the shape of the recess corresponds to that of the lower fixed blade.

16. The blade set for hair clippers as in claim 6, wherein the base is provided with two protrusions, one on a left side of the base and one on a right side of the base, for connecting the blade set to hair clippers.

* * * * *